US012042035B2

(12) United States Patent
Bianco

(10) Patent No.: US 12,042,035 B2
(45) Date of Patent: Jul. 23, 2024

(54) COSMETIC APPLICATOR WITH HEAT TRANSFER COMPONENT

(71) Applicant: Toly Management Ltd., Zejtun ZTN (MT)

(72) Inventor: Dorien Bianco, Zejtun (MT)

(73) Assignee: Toly Management Ltd., Zejtun (MT)

( * ) Notice: Subject to any disclaimer, the term of this patent is extended or adjusted under 35 U.S.C. 154(b) by 219 days.

(21) Appl. No.: 16/852,761

(22) Filed: Apr. 20, 2020

(65) Prior Publication Data

US 2020/0329846 A1 Oct. 22, 2020

(30) Foreign Application Priority Data

Apr. 20, 2019 (IN) ..... 201911015749

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01); *A45D 2200/1009* (2013.01)

(58) Field of Classification Search
CPC ..... A45D 40/267; A45D 2200/1009; A45D 34/046; A45D 40/261; A45D 34/041; A45D 34/045
See application file for complete search history.

(56) References Cited

U.S. PATENT DOCUMENTS 7,473,047 B2 1/2009 Biegel
D671,260 S 11/2012 Pires et al.
2010/0307529 A1* 12/2010 Schwab ..... A46B 3/04 401/122
2013/0121745 A1* 5/2013 Tarling ..... A45D 40/265 401/35

(Continued)

FOREIGN PATENT DOCUMENTS

EP 1080659 A2 * 3/2001 ..... A45D 34/046
FR 3021511 12/2015

(Continued)

OTHER PUBLICATIONS

KR20170011603A (Jang Up System Co Ltd) Dual applicator llip make up container, Feb. 2, 2017. [retrieved on Mar. 9, 2022], Translation retrieved from: Espacenet (Year: 2017).*

(Continued)

*Primary Examiner* — Cris L. Rodriguez
*Assistant Examiner* — Courtney N Huynh
(74) *Attorney, Agent, or Firm* — Wissing Miller LLP

(57) ABSTRACT

A cosmetic package including a cosmetic applicator for applying a composition including a cosmetic, care or pharmaceutical composition onto the keratinous substrate such as skin, lips, under eyes, eyebrows, eyelids, cheeks, or any other part of the body. The cosmetic applicator further comprises an applicator head retained at a distal end of a stem. The applicator head comprises a first applying member, a second applying member and a locking part. The first (Continued)

applying member at least partially encompasses the second applying member and wherein at least a portion of the second applying member is made of a heat transfer material to transfer the heat or cold on contact with the keratinous substrate of a user.

20 Claims, 6 Drawing Sheets

(56) References Cited

U.S. PATENT DOCUMENTS

| | | | | |
|---|---|---|---|---|
| 2014/0234003 | A1* | 8/2014 | Thorpe | A45D 34/04 132/73.5 |
| 2014/0331422 | A1* | 11/2014 | Lim | A45D 40/262 132/320 |
| 2015/0230588 | A1* | 8/2015 | Pires | A46B 9/021 401/129 |
| 2016/0045011 | A1* | 2/2016 | Sanchez | A45D 34/04 132/200 |
| 2016/0270514 | A1* | 9/2016 | Pires | A45D 40/265 |
| 2018/0027943 | A1* | 2/2018 | Rosario-Melendez | A45D 34/042 |
| 2018/0279740 | A1 | 10/2018 | Kukreja | |

FOREIGN PATENT DOCUMENTS

| | | | | |
|---|---|---|---|---|
| FR | 3021511 | A1 * | 12/2015 | A45D 40/265 |
| FR | 3025986 | | 3/2016 | |
| KR | 101702428 | | 2/2017 | |
| KR | 101702428 | B1 * | 2/2017 | |
| KR | 101702428 | B1 * | 2/2017 | A45D 34/00 |
| KR | 20170011603 | A * | 2/2017 | A45D 40/265 |
| KR | 20170011603 | A * | 2/2017 | A45D 34/04 |

OTHER PUBLICATIONS

FR3021511A1 (Oreal) (Diouf Soukai) Applicateur De Produit, Dispositif Et Procede Associes, Dec. 4, 2015. [retrieved on Jul. 1, 2021], Translation retrieved from: Espacenet (Year: 2015).*

KR20170011603A (Jang Up System Co Ltd) Dual applicator lip make up container, Feb. 2, 2017. [retrieved on Mar. 9, 2022], Translation retrieved from: Espacenet (Year: 2017).*

Kr 101702428B1 (Gong Ji-Young) (Jangup System Co., Ltd.) Rolling lip make up applicator, Feb. 16, 2017, [retrieved on Oct. 12, 2023], Translation retrieved from: Google Patents (Year: 2017).*

FR-3021511-A1 (Soukai Diouf) (LOreal SA) Product Applicator, Apparatus and Method, Dec. 4, 2015 [retrieved on Mar. 27, 2024], Translation retrieved from: Google Patents (Year: 2015).*

KR-20170011603-A (Yang Heung Sug) Dual applicator lip make up container, Feb. 2, 2017 [retreived on Mar. 27, 2024], Translation retrieved from: Google Patents (Year: 2017).*

KR-101702428-B1 (Gong Ji-Young) (Jangup Systems Co., Ltd.) Rolling lip make up applicator, Feb. 16, 2017 [retrieved on Mar. 27, 2024], Translation retrieved from: Google Patents (Year: 2017).*

* cited by examiner

COSMETIC APPLICATOR WITH HEAT TRANSFER COMPONENT

This application claims priority under 35 U.S.C. § 119 to Indian Provisional Patent Application No. 201911015749, filed on Apr. 20, 2019. The disclosure of each of these applications is incorporated herein by reference.

BACKGROUND

Field

The present disclosure relates generally relates to a cosmetic applicator for applying a product including a cosmetic, care or pharmaceutical product, onto keratinous substrate such as skin, lips, under eyes, eyebrows, eyelids, cheeks, nails or any other part of the body. In particular, the disclosure relates to an applicator for cosmetic products with an applicator head that includes a component made of a heat transfer material to transfer the heat or cold on contact with the user's keratinous substrate.

Description of the Related Art

Devices exist for dispensing cosmetic, care or pharmaceutical compositions. Some cosmetic, care or pharmaceutical compositions may include therapeutic substances, such as topical anesthetics, analgesics, fragrances, menthol, or other substances that provide a soothing or stimulating sensation when applied onto the skin of a user. In addition to therapeutic substances, heat transfer treatments (e.g., application of heat and/or cold) are also known to provide a soothing or stimulating sensation when applied onto the skin of a user. These heat transfer treatments are done separately after applying the cosmetic composition onto the skin.

To avoid separate heat transfer treatments, various cosmetic packages are already known with the metal applicators. Metal applicators are used to transfer heat or cold sensation when a cosmetic composition is applied onto the skin. This is the case in particular for eye contour products for which manufacturers of cosmetic products consider that providing a cold effect on the skin when applying the composition allows to reduce wrinkles, remove under-eye bags, attenuate signs of fatigue, firm up or tighten the skin and/or make a person look momentarily younger.

Such benefits are linked to the effect of momentary constriction of blood vessels, resulting in decreased blood flow when the skin comes into contact with the composition providing a cold sensation upon application.

The known type of cosmetic packages with the metal applicators is having complicated assemblies to dispense cosmetic products. For example, piston, valves or other parts are incorporated in the cosmetic package to control the flow of the low viscosity products. This type of complicated assemblies is expensive hence not cost effective.

Thus, a simple structure of the applicator has been desired which is capable of not only transferring hot or cold at the time of application of the composition to the skin but also capable of uniformly spreading the composition on the skin. Further, a cosmetic applicator is desired which is comfortable and easier to use.

SUMMARY

Accordingly, there is provided a cosmetic package comprising a receptacle, a cosmetic applicator and a closure. The receptacle is configured to contain a product including a cosmetic, care or pharmaceutical product. The cosmetic, care or pharmaceutical product includes viscous cosmetics, mascara, eyebrow powder, lip gloss, hair color, cheek blush, skin care, under eye cosmetics, pharmaceutical and like products.

According to an aspect of the present disclosure, the cosmetic applicator comprises an applicator head and a stem. The applicator head retained at a distal end of the stem for applying the cosmetic product; and the closure is retained at a proximal end of the stem. The distal end of the stem includes an interior longitudinal cavity for receiving and retaining the applicator head.

According to another aspect of the present disclosure, the applicator head comprises a first applying member, a second applying member and a locking part. Further, at least a portion of the first applying member extends around at least part of the second applying member. When the applicator head is seen from the front side, both the first applying member and the second applying member are accessible, however, when the applicator head is seen from the back side only the first applying member is accessible.

According to an embodiment of the present disclosure, the first applying member of the applicator head is elongated along a longitudinal axis of the applicator head and comprises a through passage extending in lengthwise direction of the first applying member. Further, the first applying member comprises a lower portion and an upper portion. The lower portion of the first applying member is cylindrical in shape, and is a shank portion. However, in alternate embodiments, the lower portion may be circular, elliptical, oblong or any other shape known in art.

The upper portion is an application portion of the first applying member and has at least one sidewall and a distal end face. The through passage opens at a distal end face of the first applying member. The distal end face is a concave surface which defines a wide opening at a distal end portion of the first applying member. The at least one sidewall has a lower cylindrical section and an upper frustoconical section with curved upper edges.

In alternate embodiments, at least a portion of the upper portion or the sidewall may be circular, cylindrical, elliptical, oblong or any other shape known in art. In alternate embodiments, the upper portion may not have curved upper edges.

The first applying member includes at least two opposite application faces namely a first face and a second face. At least one of the first face or the second face provides a large area suitable for blending for smooth and efficient application of the applied product. Further, the curved upper edges of the upper portion/ of the sidewall have an obliquely curved shape that encompasses the wide opening of the first applying member. The curved upper edges form a tapered tip at the distal end of the first applying member. This shape and the wide opening of the distal end face create a volume reservoir. This volume reservoir serves as a reservoir for the cosmetic product. A significant quantity of the cosmetic product remains accommodated on said volume reservoir which is then ready to be applied to the user's skin or keratinous substrate.

However, in alternate embodiments, the upper edge of the upper portion may not be obliquely curved and may be of any other shape known in the art.

However, in alternate embodiments, the tip may not be pointed and may be of circular, round or any other shape known in the art.

Further, the second applying member is solid body having application portion and a fitment portion. The application portion is spherical in shape and is like a ball. According to an embodiment of the present disclosure, the fitment portion is a cylindrical rod attached to or extending from the application portion.

In the preferred embodiment, a diameter of the application portion is greater than the diameter of the fitment portion, preferably at least 1.5 times greater, even more preferably 3 times greater. In variant embodiments, the fitment portion may be non-cylindrical and is of any shape known in the art. In alternate embodiments, the application portion may be non-spherical or of any other shape known in the art.

According to an embodiment of the present disclosure, threads are formed near a proximal end portion of the fitment portion.

The diameter of the application portion of the second applying member at a distal end of the second applying member is greater than the diameter of the through passage of the first applying member and the diameter of the fitment portion is less than the diameter of said through passage, therefore, when the second applying member is inserted into the through passage of the first applying member through a proximal end of the fitment portion, the application portion is retained outside the through passage in the wide opening at the distal end face of the first applying member.

According to an aspect of the present embodiment, the distal end of the first applying member comprising the tip projects beyond the distal end of the second applying member.

According to an aspect of the present embodiment, the second applying member is of a length longer than a length of the through passage of the first applying member. More specifically, a length of fitment portion is greater than a length of the through passage of the first applying member. A major length of the fitment portion lies inside the through passage of the first applying member and at least a length of the fitment portion carrying threads extends out from the proximal end of the first applying member.

According to an aspect of the present embodiment, there is provided the locking part for locking the first applying member and the second applying member together. The locking part is cylindrical in shape. However, in alternate embodiments, the locking part may not be cylindrical and may be of any shape known in the art. The locking part has a cavity which extends longitudinally throughout its complete length.

According to an embodiment, the cavity of the locking part has threads on its inner surface which can be screwed onto threads, formed on an outer surface of the fitment portion of the second applying member near its proximal end. Thus, the locking part aids in retaining and optimally locking the second applying member with respect to the first applying member such that the second applying member is axially immovable with respect to the first applying member and thus prevents the second applying member to slip out of the through passage of the first applying member.

However, in alternate embodiments, the fitment portion may snap into place on the locking part or any other type of mechanisms may be used to mate the fitment portion to the locking part.

According to an embodiment of the present disclosure, at least the application portion of the second applying member is made up of a heat transfer material which is non-reactive with or resistant to the first applying member and the cosmetic product stored in the receptacle. The heat transfer material is a metal preferably stainless steel so as to impart a hot or cold sensation on contact with the user's skin. The hot or cold sensation provided by the heat transfer material further improves the soothing effect and stimulates facial skin metabolism and improves skin elasticity.

However, in alternate embodiments, the heat transfer material may be of any other metal example aluminum, titanium, brass, silver, gold, steel, carbon, carbon fiber, nickel, tin, copper, brass, alloys thereof, or any other metal known in the art.

In yet another alternate embodiments, the heat transfer material may be non-metal for example ceramic, glass, stone, high-density plastics, composites, whether natural or synthetic or any other material known in the art capable of retaining and transferring heat or cold for a period of time.

According to an alternate embodiment, the heat transfer material may comprise or be coated with a material or substance that has antimicrobial, antiseptic, or antibacterial properties.

According to an embodiment of the present disclosure, the locking part is non-reactive with or resistant to the applying member and the cosmetic product stored in the receptacle. The locking part is made up of stainless steel. However, in alternate embodiments, the locking part may be of any other metal example, aluminum, titanium, brass, silver, gold, steel, carbon, carbon fiber, nickel, tin, copper, brass, alloys thereof, or any other metal known in the art.

In yet another alternate embodiment, the locking part may be non-metal for example ceramic, glass, stone, high-density plastics, composites, whether natural or synthetic or any other material known in the art.

According to an embodiment of the present disclosure, an outer surface of the first applying member is covered with application elements which in this case are flocked fibers. Briefly, the fibers for flocking which may be of any commonly used material, such as nylon, polyester or any natural fiber are applied with an adhesive, such as an epoxy, to the surface to be flocked. The flocking finish to the outer surface of the first applying member may be achieved by an appropriately chosen known technique, such as electrostatic flocking.

The outer surface of the first applying member before being flocked is smooth on its entire surface. That is, the outer surface of the first applying member before being flocked has no surface textures, such as a wrinkle finish or a matte finish, over the entire surface thereof. To put it another way, the outer surface of the first applying member before being flocked are smooth and slippery.

Preferably, the flocking process takes place in an electrostatic field, which results in the proper orientation of the fibers. The flock on the outer surface of the first applying member provides a convenient "reservoir" which can hold a small amount of the cosmetic product adequate for one or two applications. In alternate embodiments, the outer surface of the first applying member may include injection molded fibers, projections or grooves which are capable of holding the cosmetic product.

According to an embodiment of the present disclosure, the outer surface of the first applying member is covered by a flock coating. However, in alternate embodiments, the outer surface of the applying member may not be covered by a flock coating or may be partially covered with a flock coating.

According to an embodiment of the present disclosure, flocking is adhered to the outer surface of the first applying member by a suitable adhesive. The preferred adhesive is an epoxy adhesive.

According to yet another aspect of the present disclosure, at least a part and preferably all of the first applying member can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to an embodiment of the present disclosure, the application portion and the fitment portion of the second applying member are made up of same material. However, in alternate embodiments, the application portion and the fitment portion of the second applying member may be made up of different material.

According to an embodiment, the cosmetic package is of an elongated cylindrical configuration. However, in alternate embodiments, the cosmetic package may be of an elongated square, polygonal configuration, oval, triangular, heart, or any other configuration known in the art.

According to an aspect of the present disclosure, the closure of the cosmetic package has threads on its inner surface which can be screwed onto threads, formed on an outer surface of a neck of the receptacle. However, in alternate embodiments, the closure may snap into place on the neck of the receptacle or any other type of mechanisms may be used to mate the closure to the receptacle.

According to a further aspect of the present disclosure, there is provided, in the neck of the receptacle, a wiper for wiping off excess cosmetic product from the cosmetic applicator. The wiper also comprises an annular bead on its outer surface for engaging into a corresponding annular groove formed on an inside surface of the neck of the receptacle.

According to yet another aspect of the present disclosure, the receptacle and the closure may be made of a rigid material like glass, metal, hard plastic or any other material known in the art. However, in alternate embodiments, the receptacle and the closure may be made of a flexible material like flexible polymeric material or any other material known in the art.

According to yet another aspect of the present disclosure, the applicator head and the stem are fitted together by a snap fitment. However, in alternate embodiments, the applicator head and the stem may be fit together by friction fit, by gluing, crimping, magnetic engagement and the like.

According to yet another aspect of the present disclosure, the stem can have a longitudinal axis that is rectilinear as shown. However, in alternate embodiments, it could be curved. Further, the stem presents a cross-section that is circular, but it is not beyond the ambit of the present disclosure for this to be otherwise, in particular when the cross-section of the stem is oval, elliptical or polygonal, e.g. square, triangular or rectangular. The stem can be solid as shown, or, in a variant, it could be hollow.

When the stem is not of circular cross-section, the cap can possibly by fastened on the receptacle by snap-fastening or by some other means, without turning relative to said receptacle. The wiper can thus present a non-circular wiper orifice of section that is complementary to the section of the stem.

According to yet another aspect of the present disclosure, the first applying member can be made, at least in part, from a material that is more flexible than a material from which the stem is made.

According to an embodiment of the present disclosure, the cosmetic applicator of the cosmetic package is a dip-in applicator in which the applicator head is attached to the stem and to the receptacle carrying the product. At the time of use of said cosmetic package, the user first separates the closure from the receptacle. In order to apply the product onto the keratinous substrate such as skin, lips, eyelashes, eyebrows, eyelids, cheeks, nails or any other part of the body, the cosmetic applicator is dipped into the product in the receptacle and then can be applied by the applicator head.

According to an alternate embodiment, the cosmetic package may be configured such that the product inside the receptacle is dispensed out by a piston moving inside the receptacle. However, in alternate embodiments, the product inside the receptacle may be dispensed out by any other mechanism known in the art.

Other objects, features, and advantages of the present disclosure will become clear from the following description of the preferred embodiments when the same is read in conjunction with the accompanying drawings.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
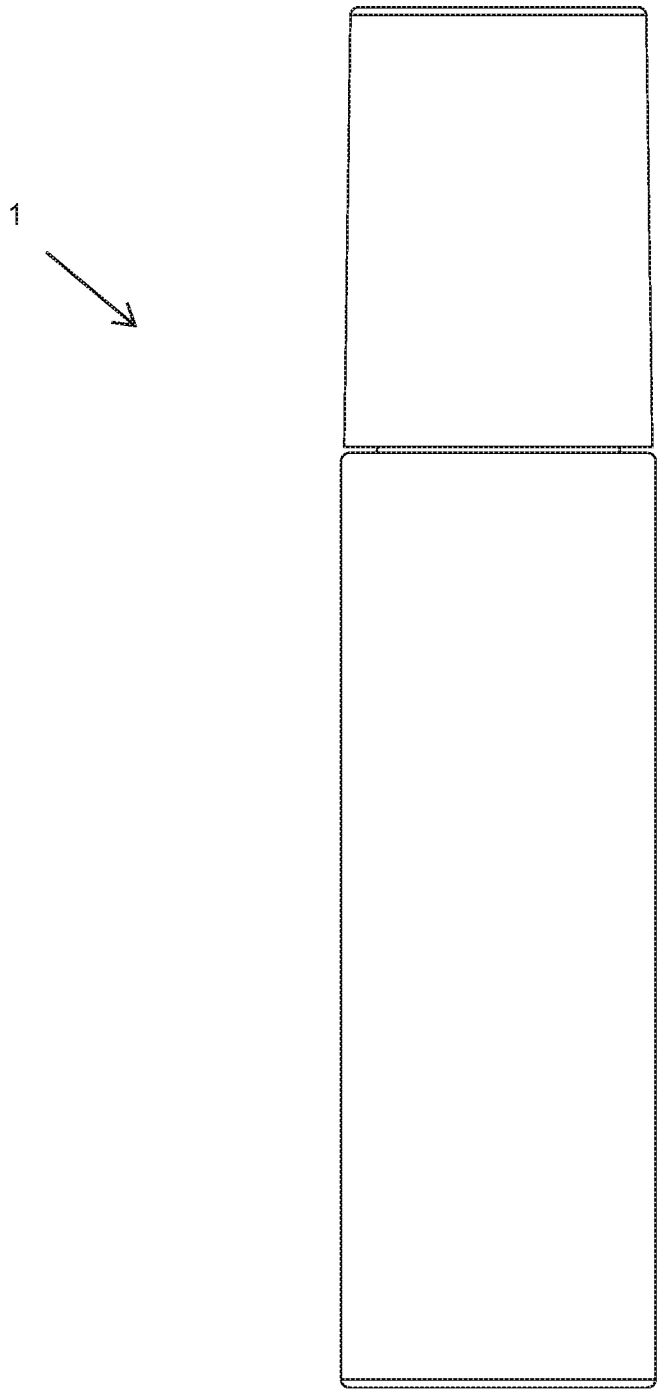
FIG. 1 illustrates a front view of a cosmetic package in closed position according to an embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

Figure 2:
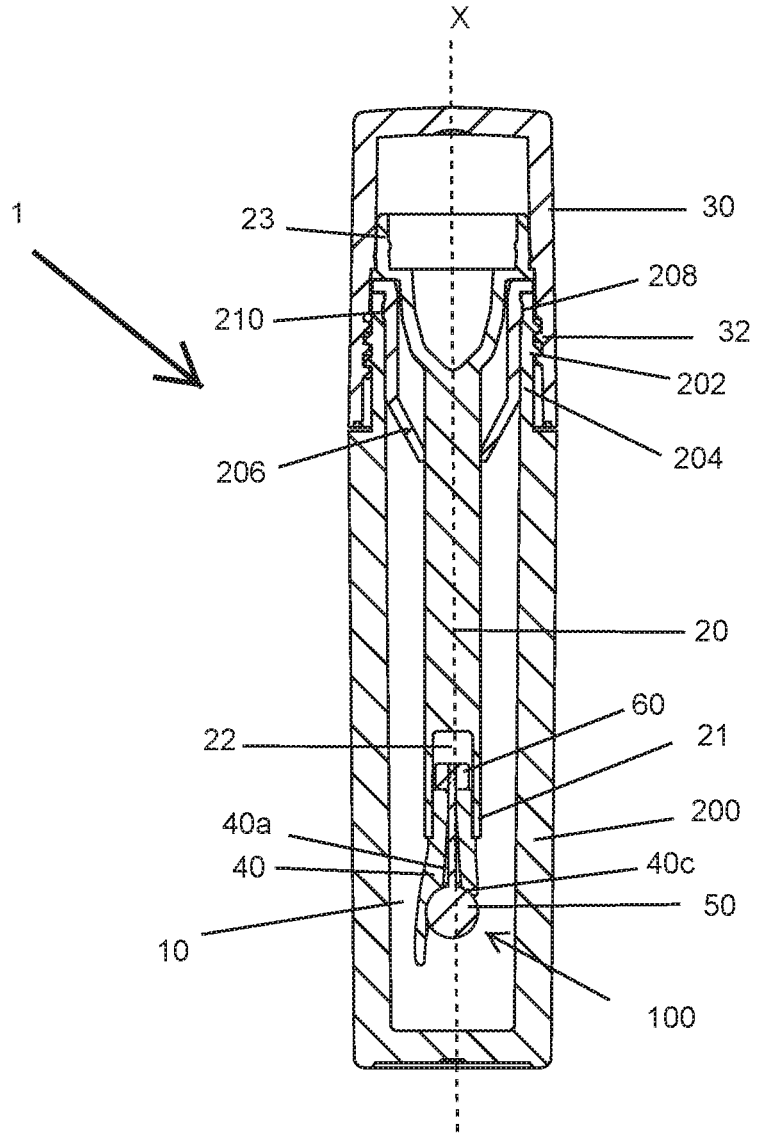
FIG. 2 illustrates a cross-sectional view of the cosmetic package of FIG. 1.

FIG. 1 illustrates a cosmetic package 1 comprising a cosmetic applicator 100 of the present disclosure. FIG. 2 illustrates a longitudinal sectional view of the cosmetic package 1 of FIG. 1. The cosmetic package 1 comprises a receptacle 200, the cosmetic applicator 100 and a closure 30. The receptacle 200 is configured to contain a product (not shown) including a cosmetic, care or pharmaceutical product. The cosmetic, care or pharmaceutical product includes viscous cosmetics, mascara, eyebrow powder, lip gloss, hair color, cheek blush, skin care, under eye cosmetics, pharmaceutical and like products.

According to an embodiment and as shown in FIGS. 1 and 2, the cosmetic package 1 is of an elongated cylindrical configuration. However, in alternate embodiments, the cosmetic package 1 may be of an elongated square, polygonal configuration, oval, triangular, heart, or any other configuration known in the art.

According to an embodiment, the closure 30 of the cosmetic package 1 has threads 32 on its inner surface which can be screwed onto threads 202, formed on an outer surface of a neck 204 of the receptacle 200. However, in alternate embodiments, the closure 30 may snap into place on the neck 204 of the receptacle 200 or any other type of mechanisms may be used to mate the closure 30 to the receptacle 200.

Inserted in the neck 204 of the receptacle 200 is a wiper 206 for wiping off excess cosmetic product from the cosmetic applicator 100. The wiper 206 also comprises an annular bead 208 on its outer surface for engaging into a corresponding annular groove 210 formed on an inside surface of the neck 204 of the receptacle 200.

According to an embodiment, the receptacle 200 and the closure 30 may be made of a rigid material like glass, metal, hard plastic or any other material known in the art. However, in alternate embodiments, the receptacle 200 and the closure 30 may be made of a flexible material like flexible polymeric material or any other material known in the art.

As shown in FIG. 2, the cosmetic applicator 100 comprises an applicator head 10 and a stem 20. The applicator head 10 is retained at a distal end 21 of the stem 20 for applying the cosmetic product; and the closure 30 is retained at a proximal end 23 of the stem 20. The distal end 21 of the stem 20 includes an interior longitudinal cavity 22 for receiving and retaining the applicator head 10. According to an embodiment of the present disclosure, the applicator head 10 and the stem 20 are fitted together by a snap fitment. However, in alternate embodiments, the applicator head 10 and the stem 20 may be fit together by friction fit, by gluing, crimping, magnetic engagement and the like.

According to an embodiment of the present disclosure, the stem 20 can have a longitudinal axis X that is rectilinear as shown. However, in alternate embodiments, it could be curved.

According to an embodiment of the present disclosure, the stem 20 presents a cross-section that is circular, but it is not beyond the ambit of the present disclosure for this to be otherwise, in particular when the cross-section of the stem 20 is oval, elliptical or polygonal, e.g. square, triangular or rectangular. The stem 20 can be solid as shown, or, in a variant, it could be hollow.

When the stem 20 is not of circular cross-section, the cap 30 can possibly by fastened on the receptacle 200 by snap-fastening or by some other means, without turning relative to said receptacle 200. The wiper 206 can thus present a non-circular wiper orifice of section that is complementary to the section of the stem 20.

Figure 4:
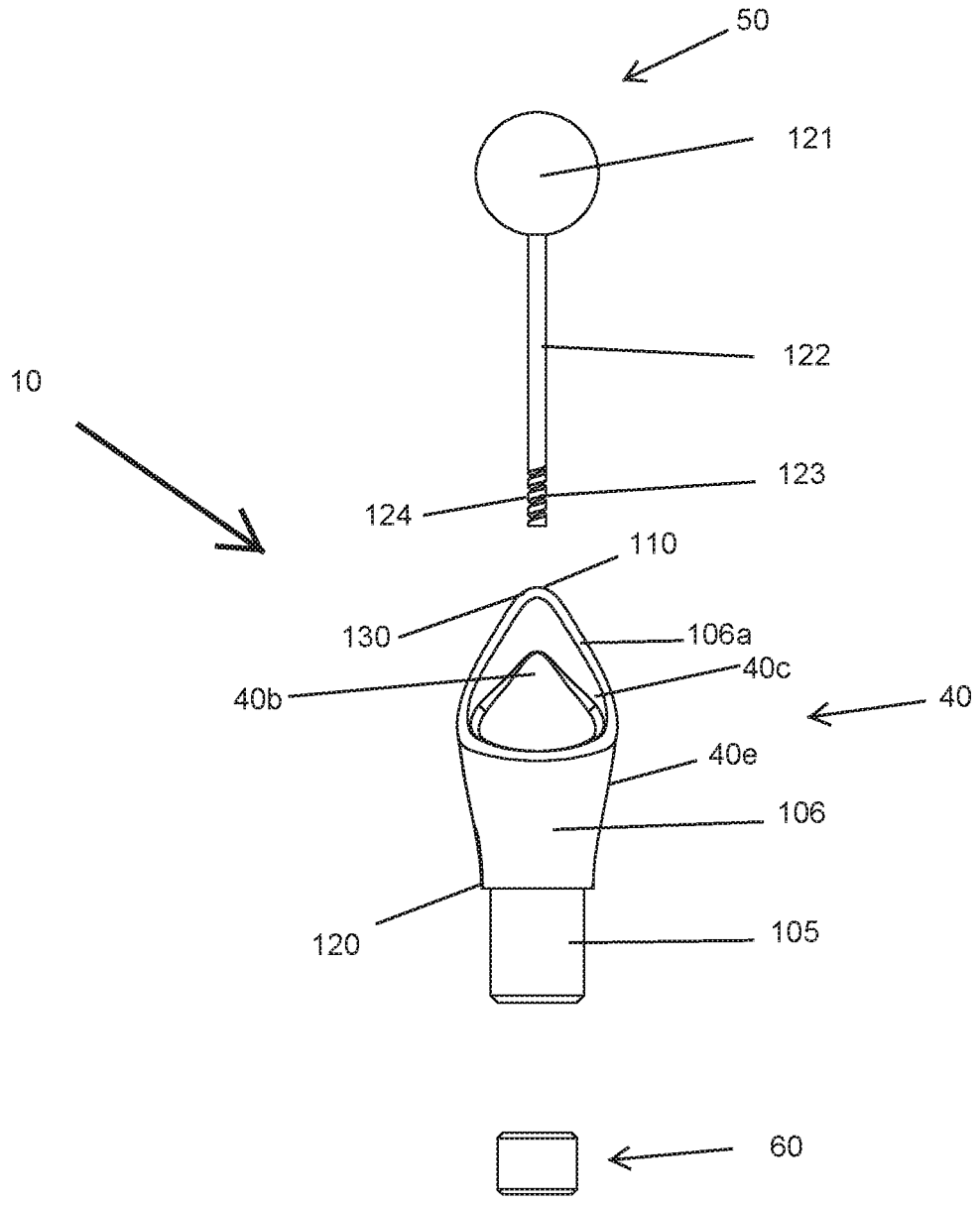
FIG. 4 illustrates an exploded view of the applicator head FIG. 3.
Figure 6:
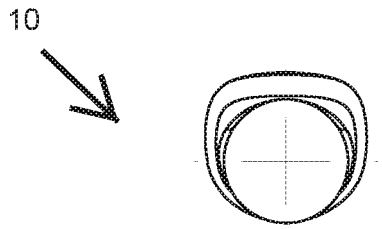
FIG. 6 illustrates a top view of the applicator head of FIG. 3.

FIG. 4 is an exploded view of the applicator head 10. The applicator head 10 comprises a first applying member 40, a second applying member 50 and a locking part 60. Further, at least a portion of the first applying member 40 extends around at least part of the second applying member 50.

Figure 3:
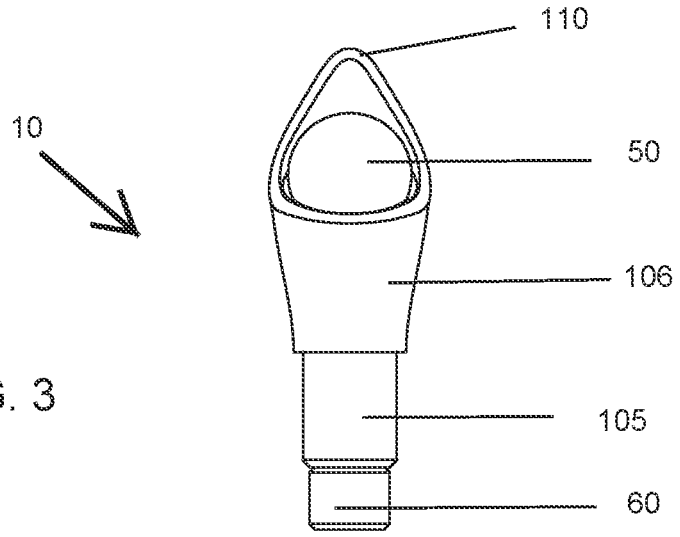
FIG. 3 illustrates a front view of an applicator head of the cosmetic package of FIG. 2.

According to an embodiment of the present disclosure, the first applying member 40 of the applicator head 10 is elongated along a longitudinal axis X-X (refer FIG. 2) and the first applying member 40 comprises a through passage 40*a* extending in lengthwise direction of the first applying member 40. Further, as shown in FIG. 3, in front view of the applicator head 10, both the first applying member 40 and the second applying member 50 are accessible. When the applicator head 10 is seen from the back side (not shown) only the first applying member 40 is accessible.

Further, as shown in FIGS. 2-3, the first applying member 40 comprises a lower portion 105 and an upper portion 106. The lower portion 105 of the first applying member 40 is cylindrical in shape and is a shank portion. However, in alternate embodiments, the lower portion 105 may be circular, elliptical, oblong or any other shape known in art.

The upper portion 106 of the first applying member 40 is an application portion and has at least one sidewall 40*e* and a concave distal face 40*c* (refer FIGS. 2 and 4). The through passage 40*a* opens in at a distal end face 40*c* of the first applying member 40. The distal end face 40*c* is a concave surface which defines a central opening 40*b* at a distal end portion of the first applying member 40 that is wider than passage 40*a*. The at least one sidewall 40*e* has a cylindrical section at the lower portion of FIGS. 3-5, and 7 and an frustoconical section with curved distal edges 106*a* at the upper portion of FIGS. 3-5, and 7. However, in alternate embodiments, at least a portion of the upper portion 106 or the sidewall 40*e* may be circular, cylindrical, elliptical, oblong or any other shape known in art. In yet alternate embodiments, the upper portion 106 may not have curved upper edges 106*a*.

Further, as shown in FIGS. 2 and 4, the curved upper edges 106*a* of the upper portion 106 have an obliquely curved shape that encompasses the wide opening 40*b* of the first applying member 40. The curved upper edges 106*a* form a tapered tip 110 at the distal end 130 of the first applying member 40.

However, in alternate embodiments, the tip 110 may not be pointed and may be of circular, round or any other shape known in the art. The lower portion 105 is stepped in from the upper portion 106 and extends from a proximal end 120 of applying member 40 by a selected distance in the proximal direction (Refer FIG. 7).

The obliquely curved shape and the wide opening 40*b* of the distal end face 40*c* create a volume reservoir. This volume reservoir serves as a reservoir for the cosmetic product. A significant quantity of the cosmetic product remains accommodated in said volume reservoir which is then ready to be applied to the user's skin or keratinous substrate. However, in alternate embodiments, the upper edge 106*a* of the upper portion 106 may not be obliquely curved and may be of any other shape known in the art.

Figure 5:
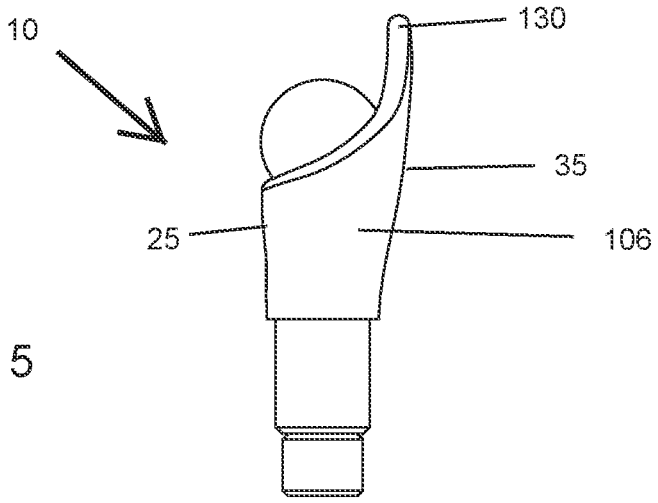
FIG. 5 illustrates a side view of the applicator head of FIG. 3.

The first applying member includes at least two opposite application faces namely a first face 25 and a second face 35 as shown in FIG. 5. The second face 35 provides a large surface area suitable for blending for smooth and efficient application of the applied product.

According to an embodiment of the present disclosure, an outer surface of the first applying member 40 is covered with application element which in this case is flocked fibers (not shown in drawings). Briefly, the fibers for flocking which may be of any commonly used material, such as nylon, polyester or any natural fiber are applied with an adhesive, such as an epoxy, to the surface to be flocked. The flocking finish to the outer surface of the first applying member 40 may be achieved by an appropriately chosen known technique, such as electrostatic flocking.

The outer surface of the first applying member 40 before being flocked is smooth on its entire surface. That is, the outer surface of the first applying member 40 before being flocked have no surface textures, such as a wrinkle finish or a matte finish, over the entire surface thereof. To put it another way, the outer surface of the first applying member 40 before being flocked are smooth and slippery.

Preferably, the flocking process takes place in an electrostatic field, which results in the proper orientation of the fibers. The flock on the outer surface of the first applying member 40 provides a convenient "reservoir" which can hold a small amount of the cosmetic product adequate for one or two applications. In alternate embodiments, the outer of the first applying member 40 may include injection molded fibers, projections or grooves which are capable of holding the cosmetic product.

Further, as seen in FIG. 4, the second applying member 50 is solid body having application portion 121 and a fitment portion 122. The application portion 121 is spherical in shape and is like a ball. However, in alternate embodiments, the application portion 121 may be non-spherical or of any other shape known in the art.

According to an embodiment of the present disclosure, the fitment portion 122 is a cylindrical rod attached to or extending from the application portion 121 towards the proximal end of the applicator head 10. In the preferred embodiment, a diameter of the application portion 121 is greater than the diameter of the fitment portion 122, preferably at least 1.5 times greater, even more preferably 3 times greater.

However, in alternate embodiments, the fitment portion 122 may be non-cylindrical and is of any shape known in the art.

According to an embodiment of the present disclosure, the threads 123 are formed near a proximal end portion 124 of the fitment portion 122. FIGS. 3, 5, 6 and 7 illustrate a front view, a side view, a top view and a cross sectional view of the applicator head 10.

A diameter of the application portion 121 of the second applying member 50 at a distal end of the second applying member 50 is greater than the diameter of the through passage 40*a* of the first applying member 40 and the diameter of the fitment portion 122 is less than the diameter of said through passage 40*a*, therefore when the second applying member 50 is inserted into the through passage 40*a* of the first applying member 40 through a proximal end of the fitment portion 122, the application portion 121 is retained outside the through passage 40*a* in the wide opening 40*b* at the distal end face 40*c* of the first applying member 40.

According to an aspect of the present embodiment, the second applying member 50 is of a length longer than a length of the through passage 40*a* of the first applying member 40. More specifically, a length of fitment portion 122 is greater than a length of the through passage 40*a* of the first applying member 40. A major length of the fitment portion 122 lies inside the through passage 40*a* of the first applying member 40 and a length of the fitment portion 122 carrying threads extends out from the proximal end 120 of the first applying member 40. According to an aspect of the present embodiment, the distal end 130 of the first applying member 40 projects beyond the distal end of the second applying member 50. As shown in FIGS. 3-7, upper edges 106*a* of sidewall 106 form the distal end 130 of the first applying member 40 and application portion 121 does not extend past the distal end 130.

Figure 7:
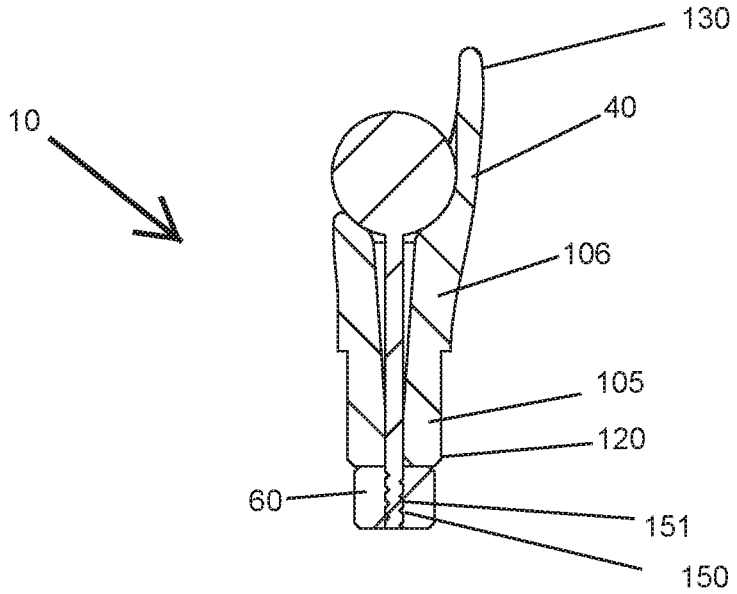
FIG. 7 illustrates a cross-sectional view of the applicator head of FIG. 3.
Figure 8:
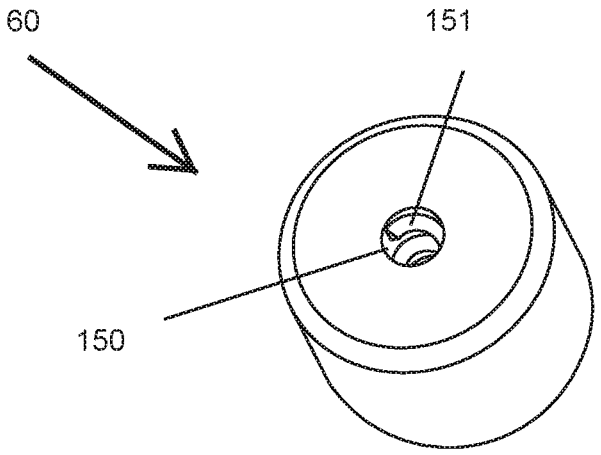
FIG. 8 illustrates an isometric view of a locking part of the applicator head of FIG. 4.

FIG. 8 is an isometric view of the locking part 60. The locking part 60 locks the first applying member 40 and the second applying member 50 together, see FIG. 7. However, in alternate embodiments, the locking part 60 may not be cylindrical and is of any shape known in the art.

Referring to FIGS. 4, 7 and 8, the locking part 60 has a cavity 150 which extends longitudinally throughout its complete length. According to an embodiment, the cavity 150 of the locking part 60 has threads 151 on its inner surface which can be screwed onto threads 123, formed on an outer surface of the fitment portion 122 of the second applying member 50 near its proximal end 124. Thus, the locking part 60 aids in retaining and optimally locking the second applying member 50 with respect to the first applying member 40 such that the second applying member 50 is axially immovable with respect to the first applying member 40 and thus prevents the second applying member 50 to slip out of the through passage 40*a* of the first applying member 40. However, in alternate embodiments, the fitment portion 122 may snap into place on the locking part 60 or any other type of mechanisms may be used to mate the fitment portion 122 to the locking part 60. Thus, as shown in FIGS. 2, 3 and 5-7, the bottom surface of the application portion of the second applying member 50 is in contact with the first applying member 40. Engagement of fitment portion 122 with through hole 40*a* prevents rotation of application portion 121.

According to an embodiment of the disclosure, second applying member 50 is fixed to first applying member by an interference fit between filament portion 122 and through passage 40*a*. According to this embodiment, through passage 40*a* is narrower than filament portion 122. First applying member 40 is formed from a material that is elastically deformed as filament portion 122 is press into through passage 40*a*. Resilient forces applied by passage 40*a* against filament portion 122 hold second applying member 50 in place with respect to first applying member.

According to an embodiment of the present disclosure, at least the application portion 121 of the second applying member 50 is made up of a heat transfer material which is non-reactive with or resistant to the first applying member 40 and the cosmetic product stored in the receptacle 200. The heat transfer material is a metal preferably stainless steel so as to impart a hot or cold sensation on contact with the user's skin. The hot or cold sensation provided by the heat transfer material further improves the soothing effect and stimulates facial skin metabolism and improves skin elasticity.

However, in alternate embodiments, the heat transfer material may be of any other metal example aluminum, titanium, brass, silver, gold, steel, carbon, carbon fiber, nickel, tin, copper, brass, alloys thereof, or any other metal known in the art. In yet alternate embodiments, the heat transfer material may be non-metal for example ceramic, glass, stone, high-density plastics, composites, whether natural or synthetic or any other material known in the art capable of retaining and transferring heat or cold for a period of time.

According to an embodiment of the present disclosure, the application portion 121 and the fitment portion 122 of the second applying member 50 are made up of same material. However, in alternate embodiments, the application portion 121 and the fitment portion 122 of the second applying member 50 may be made up of different material.

According to an alternate embodiment, the heat transfer material may comprise or be coated with a material or substance that has antimicrobial, antiseptic, or antibacterial properties.

According to an embodiment of the present disclosure, the locking part 60 is non-reactive with or resistant to the applying member 40 and the cosmetic product stored in the receptacle 200. The locking part 60 is made up of stainless steel. However in alternate embodiments, the locking part 60 may be of any other metal example, aluminum, titanium, brass, silver, gold, steel, carbon, carbon fiber, nickel, tin, copper, brass, alloys thereof, or any other metal known in the art.

In yet alternate embodiments, the locking part 60 may be non-metal for example ceramic, glass, stone, high-density plastics, composites, whether natural or synthetic or any other material known in the art.

According to an embodiment of the present disclosure, the first applying member 40 can be made, at least in part, from a material that is more flexible than a material from which the stem 20 is made. According to an embodiment of the present disclosure, at least a part and preferably all of the first applying member 40 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to an embodiment of the present disclosure, the cosmetic applicator 100 of the cosmetic package 1 is a dip-in applicator in which the applicator head 10 is attached to the stem 20 and to the receptacle 200 carrying the product. At the time of use of said cosmetic package 1, the user first separates the closure 30 from the receptacle 200. In order to apply the product onto the keratinous substrate such as skin, lips, eyelashes, eyebrows, eyelids, cheeks, nails or any other part of the body, the cosmetic applicator 100 is dipped into the product in the receptacle 200 and then can be applied by the applicator head 10.

According to an alternate embodiment, the cosmetic package 1 may be configured such that the product inside the receptacle 200 is dispensed out by a piston (not shown) moving inside the receptacle 200. However, in alternate embodiments, the product inside the receptacle 200 may be dispensed out by any other mechanism known in the art.

While the foregoing is directed to embodiments of the present disclosure, other and further embodiments of the disclosure may be devised without departing from the basic scope thereof, and the scope thereof is determined by the claims that follow.

Although, the present disclosure has been described with reference to exemplary embodiments, it is not limited thereto. Those skilled in the art will appreciate that numerous changes and modifications may be made to the preferred embodiments of the present disclosure and that such changes and modifications may be made without departing from the true spirit of the present disclosure. It is therefore intended that the appended claims be construed to cover all such equivalent variations as fall within the true spirit and scope of the present disclosure.

What is claimed is:

1. An applicator assembly for applying a substance to a keratinous surface comprising:

a stem having a longitudinal axis; and an applicator head connected with the stem and arranged along the longitudinal axis, the applicator head comprising:

an applicator member comprising a shank at a proximal end adapted to engage with a distal end of the stem, a first applying member distal of the shank, and a through passage extending through the first applying member and the shank, wherein the first applying member comprises a central opening at a distal end of the through passage and a sidewall extending at least partially about the opening; and a second applying member comprising an application portion and a fitment portion extending in a proximal direction from the application portion, wherein the application portion is a heat transfer material, wherein the application portion has a width transverse to the longitudinal axis that is larger than a width of the through passage, wherein the application portion has a convex proximal end surface that abuts and is fixed relative to the first applying member, wherein the fitment portion is inserted into the through passage, wherein the application portion fits, at least partially, in the central opening, wherein the application portion is non-rotatably fixed with respect to the first applying member and wherein the convex proximal end surface of the application portion is held in contact with a concave distal end surface of the through passage and is outside an interior of the through passage.

2. The assembly of claim 1, further comprising a locking part including a first mating mechanism, wherein a length of the fitment portion is longer than a length of the through passage, wherein a proximal portion of the fitment portion comprises a second mating mechanism, and wherein engagement of the first and second mating mechanisms fixes the second applying member to the first applying member.

3. The assembly of claim 2, wherein the first and second mating mechanisms are inter-engaging screw threads formed on an outer surface of the fitment portion and an inner surface of a hole in the locking part.

4. The assembly of claim 1, wherein the first applying member further comprises a concave distal face, wherein the sidewall at least partially surrounds the concave distal face.

5. The assembly of claim 4, wherein the sidewall has a curved distal edge, at least part of the curved distal edge extending distally of the application portion.

6. The assembly of claim 5, wherein the curved distal edge comprises a frustoconical section forming a distal tip of the applicator head.

7. The assembly of claim 4, wherein the concave distal face forms a reservoir for holding the substance.

8. The assembly of claim 1, wherein the first applying member further comprises at least one application face on a surface of the first applying member proximal of the application portion, wherein the application face is adapted to distribute or blend the substance on the keratinous surface.

9. The assembly of claim 1, wherein at least a portion of a surface of the first applying member includes a flocking finish.

10. The assembly of claim 1, wherein the application portion is spherical.

11. The assembly of claim 10, wherein the fitment portion is a cylindrical rod extending in along the longitudinal axis from the application portion in the proximal direction.

12. The assembly of claim 1, wherein the heat transfer material is selected from a metal, a ceramic, a glass, a stone, a high-density plastic, and a composite.

13. The assembly of claim 12, wherein the metal is selected from stainless steel, aluminum, titanium, brass, silver, gold, steel, carbon, carbon fiber, nickel, tin, copper, brass, and alloys thereof.

14. The assembly of claim 13, wherein the metal is stainless steel.

15. The assembly of claim 1, wherein the heat transfer material comprises a coating selected from one or more of an antimicrobial coating, an antiseptic coating, and an antibacterial coating.

16. The assembly of claim 1, wherein the first applying member is formed from a polymer material selected from a thermoplastic, an elastomer, a rubber, a polyester, and a copolymer.

17. The assembly of claim 16, wherein the first applying member is formed by injection molding.

18. The assembly of claim 1, wherein the stem comprises a distal cylindrical cavity and wherein the shank comprises a cylindrical portion sized to engage the distal cylindrical cavity.

19. An applicator assembly for applying a substance to a keratinous surface comprising:

a stem having a longitudinal axis; and an applicator head connected with the stem and arranged along the longitudinal axis, the applicator head comprising:

an applicator member comprising a shank at a proximal end adapted to engage with a distal end of the stem, a first applying member distal of the shank, and a through passage extending through the first applying member and the shank, wherein the first applying member comprises a central opening at a distal end of the through passage and a sidewall extending at least partially about the opening; and a second applying member comprising an application portion and a fitment portion extending in a proximal direction from the application portion, wherein the application portion is a heat transfer material, wherein the application portion has a width transverse to the longitudinal axis that is larger than a width of the through passage, wherein the application portion has a convex proximal end surface that abuts and is fixed relative to the first applying member, wherein the fitment portion is inserted into the through passage, wherein the application portion fits, at least partially, in the central opening, wherein the application portion is non-rotatably fixed with respect to the first applying member, wherein the convex proximal end surface of the application portion is held in contact with a concave distal end surface of the through passage and is outside an interior of the through passage and wherein the application portion does not extend past a distal end portion of the sidewall which extends at least partially about the opening.

20. The assembly of claim 19, wherein the distal end portion of the sidewall comprises curved upper edges forming a tapered tip.

* * * * *